United States Patent [19]

Olsen et al.

[11] 4,385,721

[45] May 31, 1983

[54] TRAY CORNER STRUCTURE

[75] Inventors: Robert C. Olsen, Cupertino; James R. Jensen, Fremont, both of Calif.

[73] Assignee: Container Corporation of America, Chicago, Ill.

[21] Appl. No.: 300,399

[22] Filed: Sep. 8, 1981

[51] Int. Cl.[3] ..... B65D 5/26

[52] U.S. Cl. ..... 229/32

[58] Field of Search ..... 229/32, 35

[56] References Cited

U.S. PATENT DOCUMENTS

| | | | |
|---|---|---|---|
| 1,910,480 | 5/1933 | Shomaker | 229/35 |
| 2,180,104 | 11/1939 | De Marco | 229/35 |
| 3,871,570 | 3/1975 | Garmon | 229/32 |
| 3,899,121 | 8/1975 | Herbetho | 229/35 |

FOREIGN PATENT DOCUMENTS

| | | | |
|---|---|---|---|
| 2387173 | 12/1978 | France | 229/35 |
| 2463065 | 3/1981 | France | 229/32 |
| 737685 | 9/1955 | United Kingdom | 229/35 |

*Primary Examiner*—Herbert F. Ross

*Attorney, Agent, or Firm*—Richard W. Carpenter; Davis Chin

[57] ABSTRACT

Paperboard tray having a corner structure with double interlocking relation between portions of the end and side walls.

1 Claim, 5 Drawing Figures

TRAY CORNER STRUCTURE

BACKGROUND OF THE INVENTION

1. Field of the Invention

This invention relates generally to paperboard trays and, more particularly, to a specific corner structure which is adapted to add stacking strength to the tray.

2. Description of the Prior Art

A prior art search directed to the subject matter of this application in the U.S. Patent and Trademark Office revealed the following prior art patents:

U.S. Pat. No. Re.: 25,050; U.S. Pat. Nos. 855,746; 1,585,390; 2,113,097; 2,147,675; 2,468,951; 2,568,145; 2,665,836; 2,914,235; 2,965,279; 3,118,591; 3,162,350; 3,744,706; 3,810,574; 3,871,570; 3,917,156; 3,918,630; 3,929,273; 4,058,249; 4,197,980; 4,208,007; 4,236,740; French Pat. Nos.: 2,329,523; 2,385,592; 2,387,162.

None of the prior art patents uncovered in the search disclosed the specific double interlocking inner and outer corner flap arrangement for the tray which helps maintain the end wall in a vertical position to afford additional stacking strength for the tray.

SUMMARY OF THE INVENTION

This invention relates paperboard trays and, more particularly, to corrugated paperboard trays such as those used in the produce field, which are often times required to be stacked with similar trays filled with packaged products.

In conventional trays of this type there is a tendency for the end walls to sag or bow outwardly instead of being maintained in the vertical position. When this happens, trays stacked up with other trays tend to slip or fall, causing damage to the product contained therein.

Trays of this type can be formed with extra plys of paperboard to reinforce the corners, but, of course, this increases substantially the cost of the tray.

It is therefore a primary object of this invention to provide an economical paperboard tray of simple design and construction having a particular corner arrangement which will help maintain the end walls in a vertical position at all times.

A more specific object of the invention is to provide, in a tray of the type described, a specific corner arrangement with a double locking connection between an end wall flap and a sidewall that prevents movement of the end wall away from the sidewall.

These and other objects of the invention will be apparent from the examination of the following description and drawings.

It will be understood that for purposes of clarity certain elements may have been intentionally omitted from certain views where they are believed to be illustrated to better advantage in other views.

DESCRIPTION OF THE PREFERRED EMBODIMENT

Figure 4:
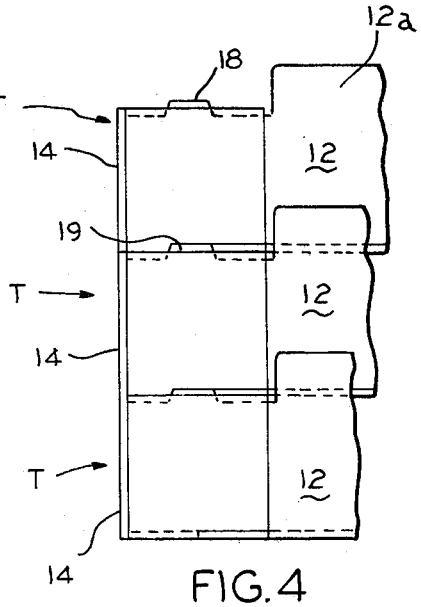
FIG. 4 is a view similar to FIG. 3 but illustrating a plurality of trays stacked one on top of the other.
Figure 5:
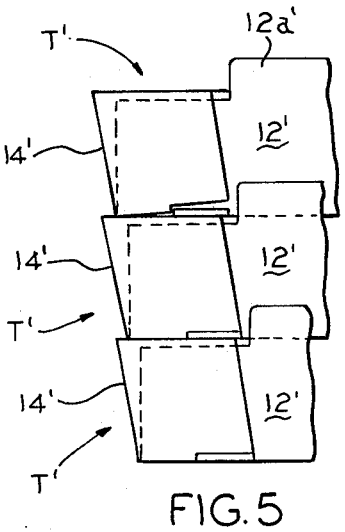
FIG. 5 is a view similar to FIG. 4 but illustrating a plurality of stacked trays of the prior art type which do not have the novel features of the present invention.

Referring now to the drawings for a better understanding of the invention, and first to FIGS. 4 and 5, it will be seen that there is illustrated a comparison between the prior art trays illustrated in FIG. 5 and the trays embodying the novel features of this invention illustrated in FIG. 4. As previously stated, the purpose of this invention is to provide a corner construction which will enable the end walls to stand up straight to permit uniform and even stacking of plurality of trays without sagging and drooping as often happens with trays of a conventional design, as illustrated in FIG. 5.

Figure 1:
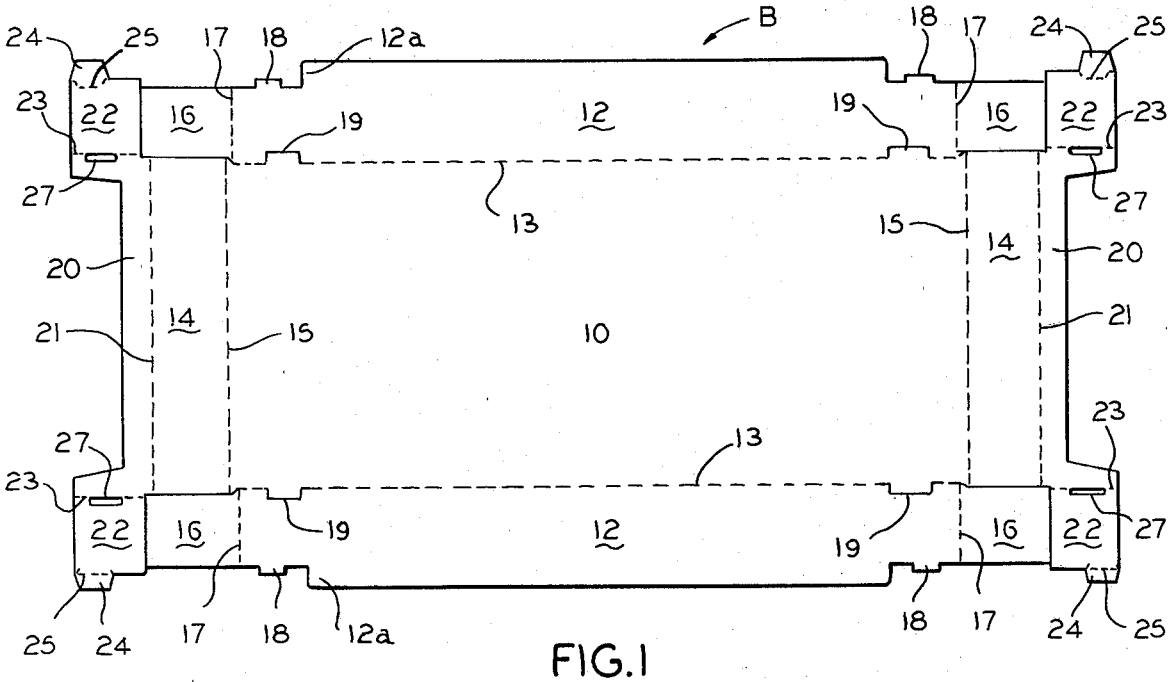
FIG. 1 is a plan view of a blank of foldable sheet material from which the tray illustrated in the other views may be formed.
Figure 2:
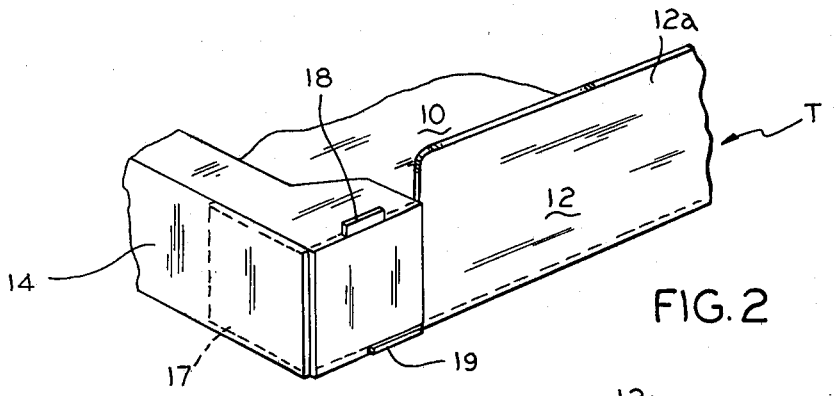
FIG. 2 is a fragmentary perspective view of one corner of a tray embodying features of the invention.
Figure 3:
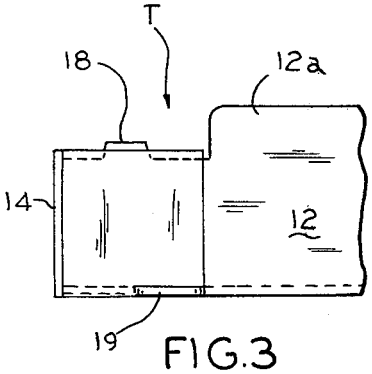
FIG. 3 is a fragmentary side elevational view of a portion of the structure of FIG. 2.

Referring now to FIGS. 1 and 2 of the invention, it will be seen that the novel tray, indicated generally at T in FIG. 2, may be formed from a unitary blank B of foldable sheet material, such as paperboard, illustrated in FIG. 1.

Still referring to FIGS. 1 and 2, it will be seen that the tray includes a preferably rectangular flat bottom wall panel 10 having opposed side walls 12 and opposed end walls 14 foldably joined, along fold lines 13 and 15, to oppose side and end edges thereof and upstanding therefrom to form therewith a box-like enclosure open at the top.

Each of the sidewall panels 12 have foldably joined to each end thereof an inner corner flap 16, which is adapted to be folded inwardly at right angles thereto so as lie against the inner face of an adjacent end wall panel 14.

It will be noted that the center portions 12*a* of each of the sidewall panels 12 extend upwardly above the end portions of the sidewall panel. At each end thereof each sidewall panel 12 presents a lock tab 18 projecting upwardly from an upper edge thereof and presents a lock tab receiving opening 19 extending through a lower portion thereof adjacent related fold line 13. The purpose of the lock tab 18 and lock tab receiving opening 19 will be explained later in the specification.

Each of the end wall panels 14 has foldably joined to the upper edge thereof, along a fold line 21, a relatively narrow, elongated top wall panel 20. A pair of outer corner flaps 22 are foldably joined to opposite end edges of each top wall panel 20 along fold lines 23.

Each flap 22 also has a lock tab 24 foldably joined thereto, along an opposite edge on a fold line 25. Also, it will be noted that each of the top wall panels 20 has, at each end thereof, a lock tab receiving opening 27 which is disposed inwardly adjacent related fold line 23.

When the tray is erected with the side and end wall panels folded upwardly at right angles to the bottom wall panel 10, as previously described, inner corner flaps 16 are folded inwardly at right angles from related sidewall panels 12 to lie against the inner face of adjacent end wall panels 14. Each of the top wall panels 20 are folded inwardly at right angles from their related end wall panels 14 so as to lie in parallel spaced relation with end portions of bottom wall panel 10 and with sidewall panel lock tabs 18, extending upwardly through top wall panel lock tab receiving openings 27.

At the same time outer corner flaps 22 are folded downwardly, at right angles from the top wall panels 20, so as to overlie the outer surfaces of adjacent portions of related sidewall panels 12, with the lock tabs 24 of the outer corner flap 22 being received within the lock tab receiving opening 19 of the adjacent sidewall panels 12.

Thus, it will be seen that there is a double connection with the sidewall panel lock tabs 18 being received within the top wall panel openings 27 and with the outer corner flap lock tabs 24 being received within the sidewall panel openings 19 to provide a double interlocking connection at each corner of the tray between related end and sidewall panels.

What is claimed is:

1. An open top, readily stackable, tray type container formed of a unitary blank of foldable paperboard and comprising:

(a) a generally rectangular bottom wall panel having upstanding therefrom opposed side and end wall panels foldably joined to opposite side and end edges thereof and to each other to form therewith a box-like enclosure open at the top;

(b) each of said side wall panels having at each end thereof;

(i) an inner corner flap having top and bottom edges which are generally parallel for their entire length, being foldably joined to an end edge thereof, extending normal thereto, and being disposed against an adjacent inner surface of a related end wall panel;

(ii) a lock tab projecting upwardly from an upper edge of said side wall panel;

(iii) a lock opening extending through said side wall panel adjacent a lower edge thereof;

(c) a pair of relatively narrow top wall panels foldably joined to upper edges of respective end wall panels and disposed to extend inwardly therefrom and normal thereto;

(d) each of said top wall panels having at each side thereof;

(i) an outer corner flap foldably joined to a side edge thereof and disposed against an adjacent outer surface of a related side wall panel;

(ii) said outer corner flap having foldably joined to a lower edge thereof a lock tab projecting inwardly therefrom for receipt within a related side wall panel lock opening;

(iii) a lock opening extending therethrough adjacent the side edge of said outer corner flap for receipt of related side wall panel lock tab.

* * * * *

Disclaimer 4,385,721.—*Robert C. Olsen,* Cupertino and *James R. Jensen,* Fremont, Calif. TRAY CORNER STRUCTURE. Patent dated May 31, 1983. Disclaimer filed Jan. 23, 1984, by the assignee, *Container Corp. of America.*

Hereby enters this disclaimer to the sole claim of said patent.

[*Official Gazette March 27, 1984.*]